US005787867A

United States Patent [19]

Schnaibel et al.

[11] Patent Number: 5,787,867

[45] Date of Patent: Aug. 4, 1998

[54] LAMBDA CONTROL METHOD

[75] Inventors: Eberhard Schnaibel, Hemmingen; Lothar Raff, Remseck; Ernst Wild, Oberriexingen; Klaus Hirschmann, Leonberg; Frank Blischke, Hildesheim, all of Germany

[73] Assignee: Robert Bosch GmbH, Stuttgart, Germany

[21] Appl. No.: 816,377

[22] Filed: Mar. 13, 1997

[30] Foreign Application Priority Data

Mar. 15, 1996 [DE] Germany ..... 196 10 170.0

[51] Int. Cl.[6] ..... F02D 41/14

[52] U.S. Cl. ..... 123/674; 60/274; 60/285; 123/696

[58] Field of Search ..... 123/674, 693, 123/694, 696; 60/274, 276, 285

[56] References Cited

U.S. PATENT DOCUMENTS

| | | | |
|---|---|---|---|
| 4,300,507 | 11/1981 | Reddy | 123/696 |
| 4,364,356 | 12/1982 | Gerhold | 123/694 X |
| 4,697,564 | 10/1987 | Ohgami et al. | 123/694 X |
| 5,117,631 | 6/1992 | Moser | 60/274 |
| 5,220,905 | 6/1993 | Lundahl | 123/681 |
| 5,433,185 | 7/1995 | Toyoda | 123/696 X |
| 5,586,543 | 12/1996 | Schnaibel et al. | 123/696 |

FOREIGN PATENT DOCUMENTS 1567552 5/1980 United Kingdom .

*Primary Examiner*—Tony M. Argenbright
*Attorney, Agent, or Firm*—Walter Ottesen

[57] ABSTRACT

The invention is directed to a method for controlling the composition of the air/fuel mixture for an internal combustion engine. In the method, the mean value of the control oscillation is influenced via a change of the delay times tv with which a sign reversal of the actuating variable change is delayed. The dead time of the control is determined from the time-dependent performance of the control actuating variable and is considered for the change of the delay times tv.

10 Claims, 5 Drawing Sheets

LAMBDA CONTROL METHOD

FIELD OF THE INVENTION

The invention relates to a lambda control method for internal combustion engines.

BACKGROUND OF THE INVENTION

The common exhaust-gas probe, which is used in the context of lambda control, supplies a signal level of approximately 100 millivolts for a lean mixture and a signal level of approximately 900 millivolts in the operating state for a fuel rich mixture.

This probe is especially suitable for control to $\lambda=1$ with a PI control or even a PID control via a comparatively steep and temperature stable signal level change in the region of the stoichiometric composition ($\lambda=1$) of the air/fuel mixture.

The interrelationship of this control characteristic and probe characteristic with the dead time of the control path leads to a periodic fluctuation of the actual value about the desired value. This control path is defined, in part, by the vapor transport time between the location where the mixture is formed in the intake pipe and the location in the exhaust system where the probe is mounted. For a symmetrical fluctuation of the actual value, the desired value ($\lambda=1$) is maintained in time average.

To control to desired values $\lambda\neq1$, the symmetry of the control fluctuation is deliberately influenced. This can, for example, be effected via unsymmetrical integrator slopes, proportional components or delay times tv which delay a direction reversal of the controller output signal when there is a change of the probe signal level.

Such a system is, for example, disclosed in U.S. Pat. No. 5,117,631 incorporated herein by reference. This patent describes systems with only one probe forward of the catalytic converter as well as systems with a probe forward of the catalytic converter and a probe rearward of the catalytic converter. In this patent, a control on the basis of time-averaged actual values is superposed on the control on the basis of the instantaneous actual value. If the averaged actual value deviates from a desired value, then an intervention is made on the control parameters in the control loop of the instantaneous actual value. This intervention can, for example, take place with respect to delay times. The precise adjustment of a desired $\Delta\lambda$ to $\lambda=1$ is made more difficult because $\Delta\lambda$ is not only dependent upon the delay time tv but also on the dead time tt of the control path independently as to whether the intervention is with respect to the delay time in dependence upon operating parameters such as load, rpm, et cetera or is in dependence upon the signal of the probe mounted rearward of the catalytic converter. The dead time tt encompasses that time between the change of the mixture composition in advance of the combustion process to the reaction of the exhaust-gas probe to this change after the combustion. The dead time tt then includes essentially the transit time (of the air/fuel mixture) between the intake pipe and the exhaust-gas probe and the dead time tS specific to the probe. This dead time tS is between a change of the oxygen content at the probe and the resulting change of the probe signal level. The fuel/air mixture transit time is dependent at least upon the load and the rpm of the engine. The dead time of the exhaust-gas probe changes with increasing deterioration. The penetration of the delay times tv on the $\Delta\lambda$ to be adjusted is therefore dependent at least upon the operating point of the internal combustion engine and on the deterioration of the exhaust-gas probe. The total dead time of the control path increases with increasing deterioration of the probe. This total dead time of the control path furthermore effects an increase of the amplitude of the control oscillation. This increase is unwanted because the larger fluctuations of the oxygen content associated therewith operate disadvantageously in the exhaust gas on the conversion of toxic substances in the catalytic converter.

SUMMARY OF THE INVENTION

In view of the foregoing, it is an object of the invention to provide a method for controlling the mixture composition of an internal combustion engine wherein the operation of delay times tv on a desired mixture shift $\Delta\lambda$ is not dependent upon the dead time of the probe.

The method of the invention of controlling the composition of the air/fuel mixture for an internal combustion engine has a control system defining a control path and generates a control actuating variable (FR). The method includes the steps of: monitoring a periodic oscillation of the control actuating variable (FR) and forming the mean value of the oscillation; determining the dead time (tt) of the control system from the performance of the control actuating variable (FR); and, influencing the mean value by changing a delay time tv while considering the dead time (tt) to thereby delay a change of sign of the control actuating variable (FR).

In an advantageous embodiment of the invention, the amplitude of the control oscillation is additionally adjusted to a pregiven value. This contributes to a reduction of the load on the catalytic converter.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
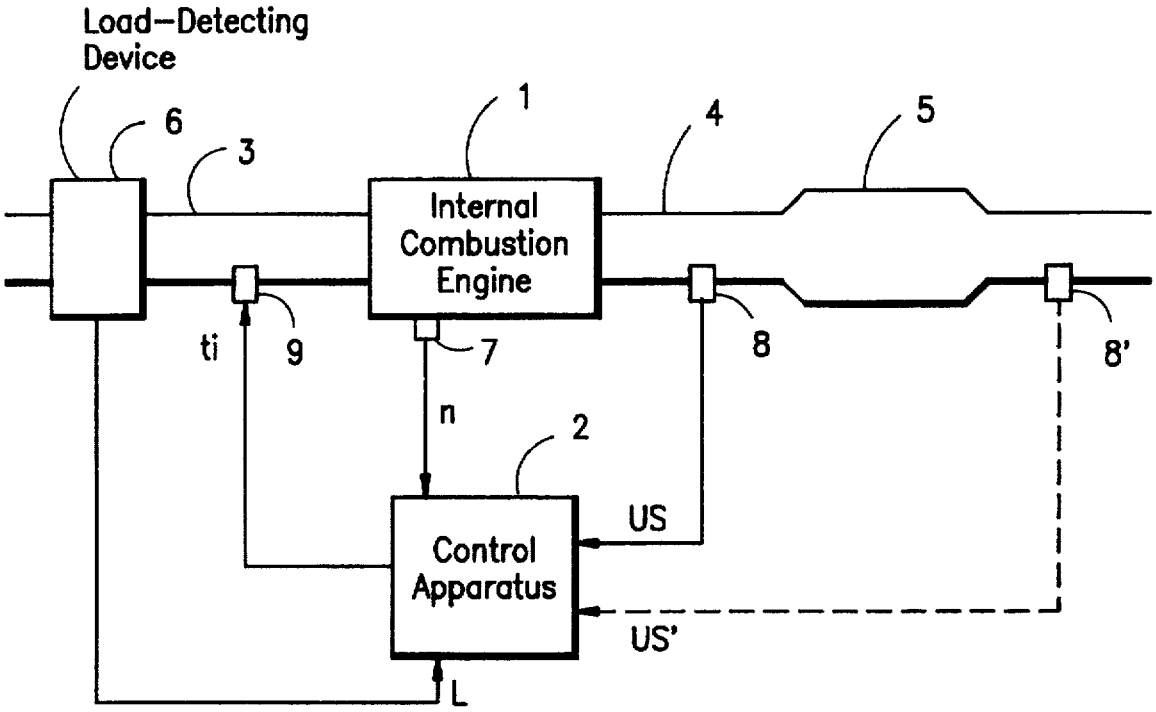
FIG. 1 is a schematic showing the mixture control loop of an internal combustion engine to define the technical background in which the invention achieves its advantages.

Referring to FIG. 1, reference numeral 1 identifies an internal combustion engine having an intake pipe 3 and an exhaust-gas system 4. Reference numeral 2 identifies a control apparatus. Signals as to the operating parameters of the engine are supplied to the control apparatus 2. The signal L of a load-detecting device 6 and the signal n of an rpm sensor 7 are shown. Also shown are the signal US of an exhaust-gas probe 8 mounted forward of the catalytic converter 5 and the signal US' of an exhaust-gas probe 8' arranged rearward of the catalytic converter. The exhaust-gas probe 8' is not absolutely necessary for carrying out the method of the invention.

The method of the invention can, however, be advantageously applied for a two-probe system. The control apparatus 2 forms a fuel-metering signal ti from these signals and additional signals. With the signal ti, a fuel-metering device 9 (for example, in the form of an injection valve arrangement) is driven.

Figure 2:
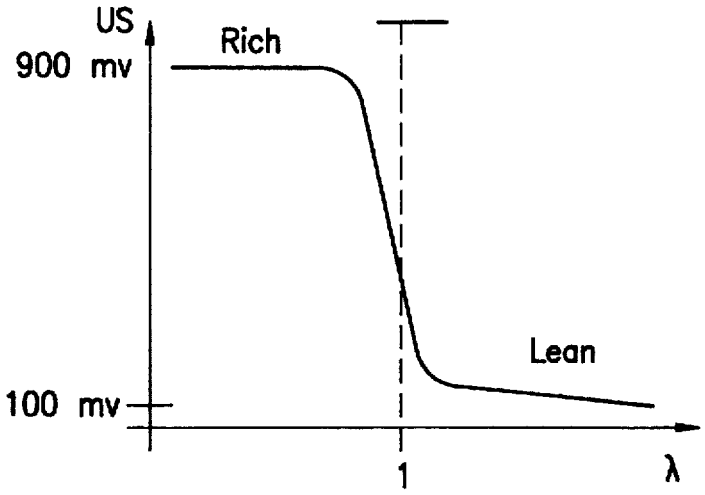
FIG. 2 shows the output signal of an exhaust-gas probe as it is used in the mixture control loop of FIG. 1.

FIG. 2 shows the known signal of an operationally warm exhaust-gas probe of the Nernst type.

Figure 3:
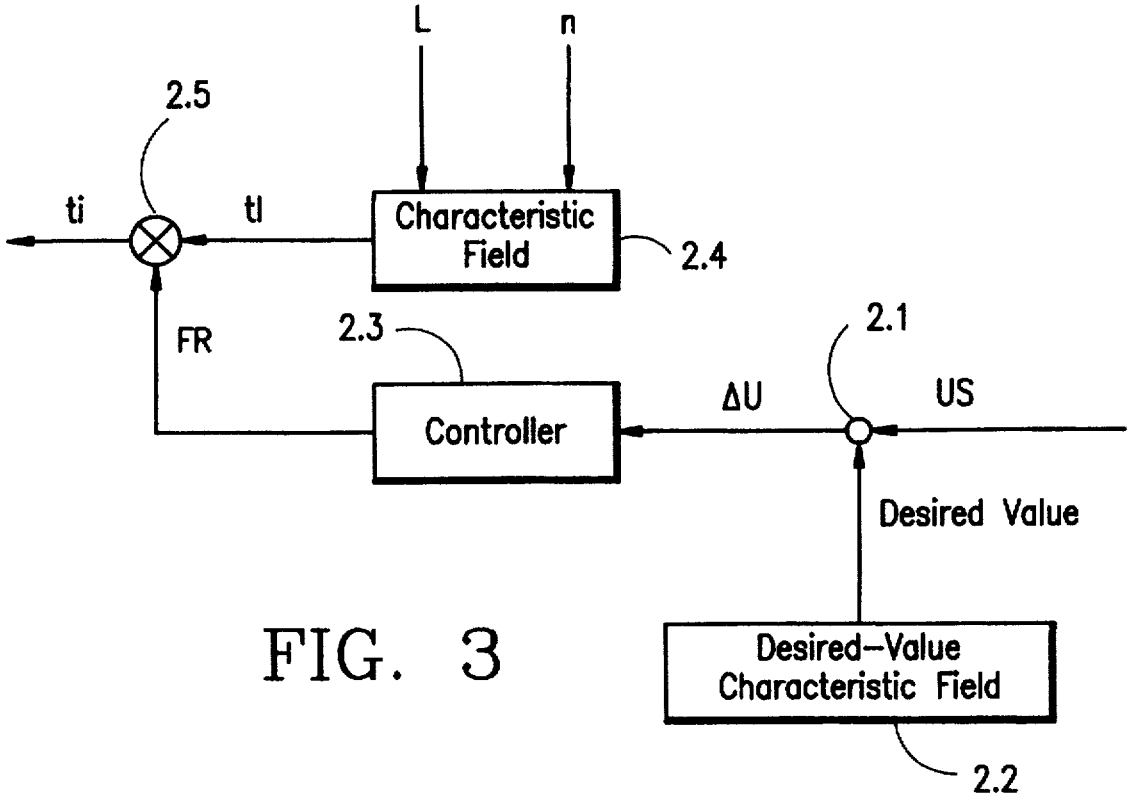
FIG. 3 shows, inter alia, the formation of the control actuating variable in the mixture control loop of FIG. 1.

FIG. 3 shows how the fuel-metering signal is formed, especially with respect to the formation of the control actuating variable FR. The signal US of the exhaust-gas probe is compared in the comparator element 2.1 to a desired value from a desired-value characteristic field 2.2. The deviation ΔU is supplied to a controller 2.3 which forms a control actuating variable FR therefrom. A base metering signal tl is outputted by a characteristic field 2.4 and is logically multiplicatively coupled in logic element 2.5 with the control actuating variable FR to form the fuel-metering signal ti.

Figure 4:
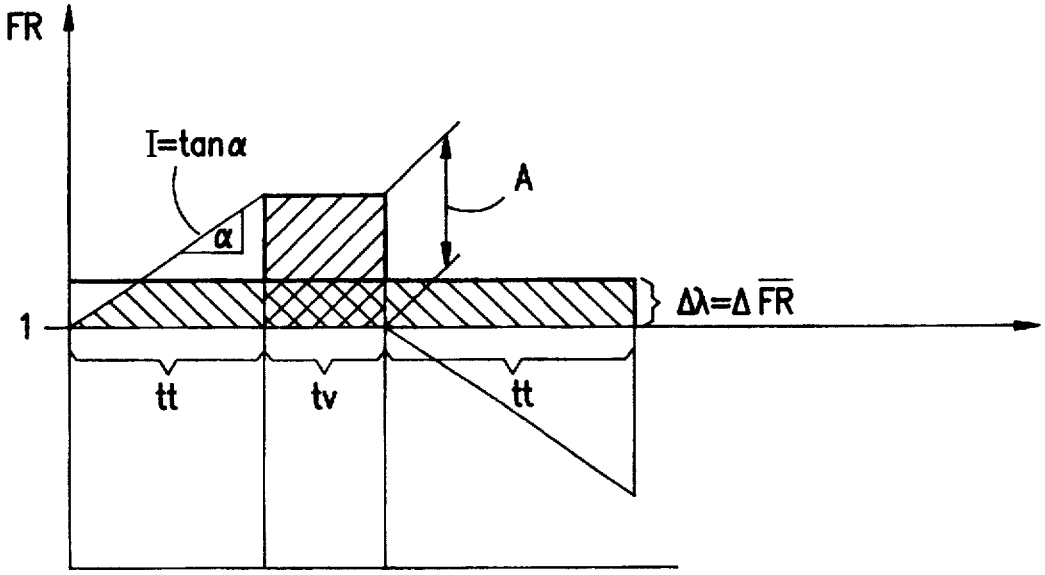
FIG. 4 shows, inter alia, a graph of the periodic oscillation of the control actuating variable.

FIG. 4 shows a segment of the time-dependent trace of the control actuating variable FR. At time point t=0, the mixture composition in the intake pipe had changed from lean to rich. The exhaust-gas probe transmits this change to the control apparatus only after a dead time tt. For this reason, the variable FR continues to be linearly increased which corresponds to a further enrichment. After the elapse of the dead time tt, the exhaust-gas probe registers the change of the mixture composition. In the embodiment shown, the actuating variable FR is held constant for a delay time span tv before a jump-like adjustment in the lean direction takes place and a linear change in the direction toward lean follows.

The direction reversal of the actuating variable change is delayed by the time span tv and effects a displacement Δλ of the time-averaged mixture composition λ.

For a desired Δλ, the required tv is proportional to Δλ and to the dead time tt and the required tv is inversely proportional to the difference of the amplitude A and desired λ. Stated otherwise, the operation of the delay time tv on Δλ is dependent upon the dead time of the control path and the amplitude of the control oscillation.

The value of the rate of change as well as the value of the amplitude of the actuating variable FR are present in the control apparatus or can be derived from variables present in the control apparatus in a simple manner.

According to the invention, the dead time of the control path is determined from an evaluation of the amplitude and is considered when setting a delay time tv to adjust a desired λ.

Stated otherwise, the invention considers that the effectivity of the delay time tv on Δλ is dependent upon the dead time of the control path and the amplitude of the control oscillation. The amplitude results as a product of the rate of change I, the control actuating variable FR and the dead time tt. For a known rate of change, the amplitude is therefore a measure of the dead time.

Figure 5:
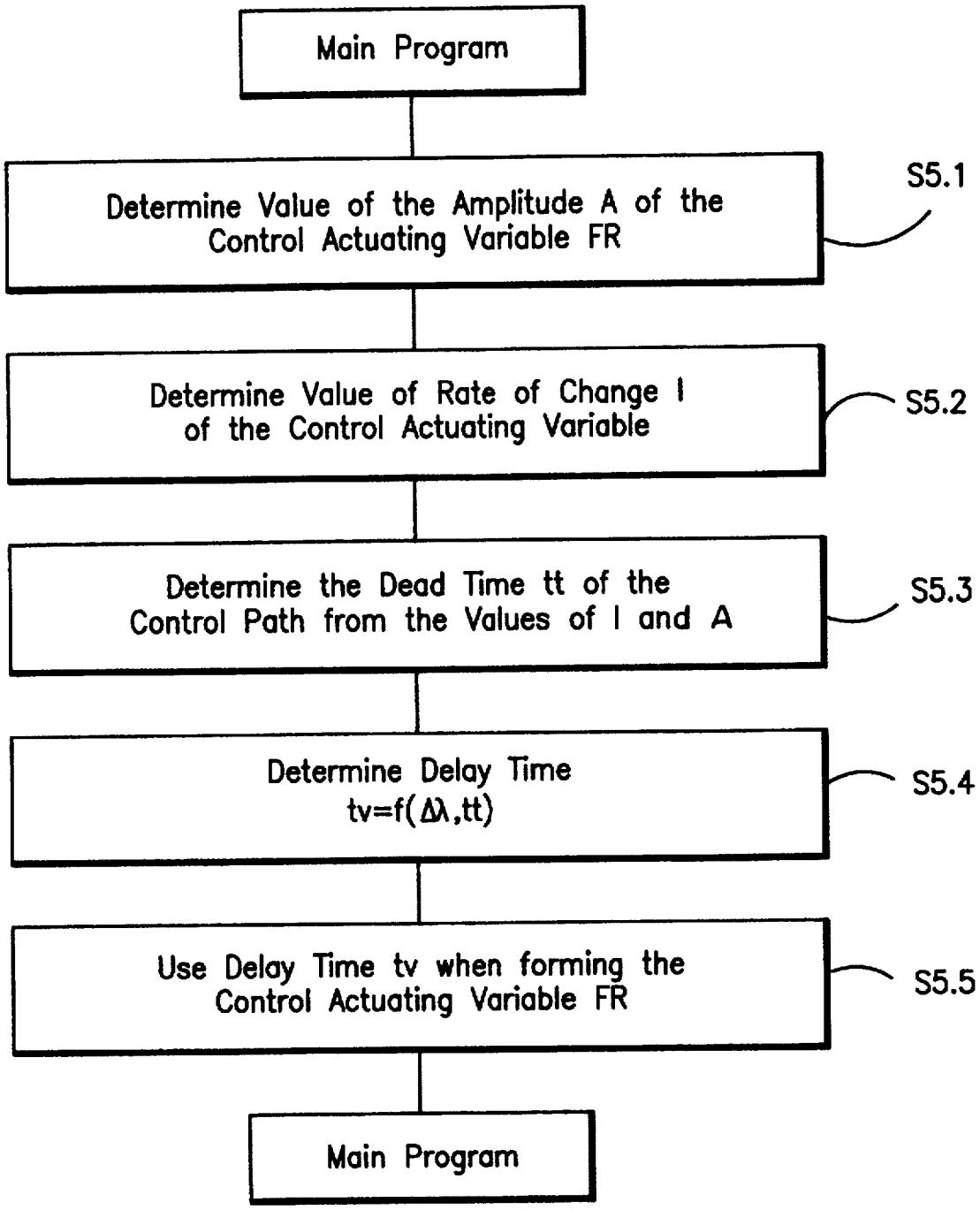
FIG. 5 shows an embodiment of the method of the invention in the context of a flowchart.

FIG. 5 shows an embodiment of the invention in the form of a flowchart. The step S5.1 is reached from a higher-order engine control main program. In step S5.1, the value of the amplitude A of the control actuating variable FR is determined. The amplitude A can, for example, be defined as half the spacing of the extreme values of the control actuating variable FR. In step S5.2, the value of the rate of change I of the actuating variable is determined before, in step S5.3, the dead time tt of the control path is determined from the values I and A. Thereafter, in step S5.4, the determination of the delay time tv is made as a function of the desired Δλ and the determined dead time tt. In step S5.5, this delay time tv is used in the formation of the control actuating variable FR and, thereafter, further processing takes place with the higher-order main program.

Figure 6:
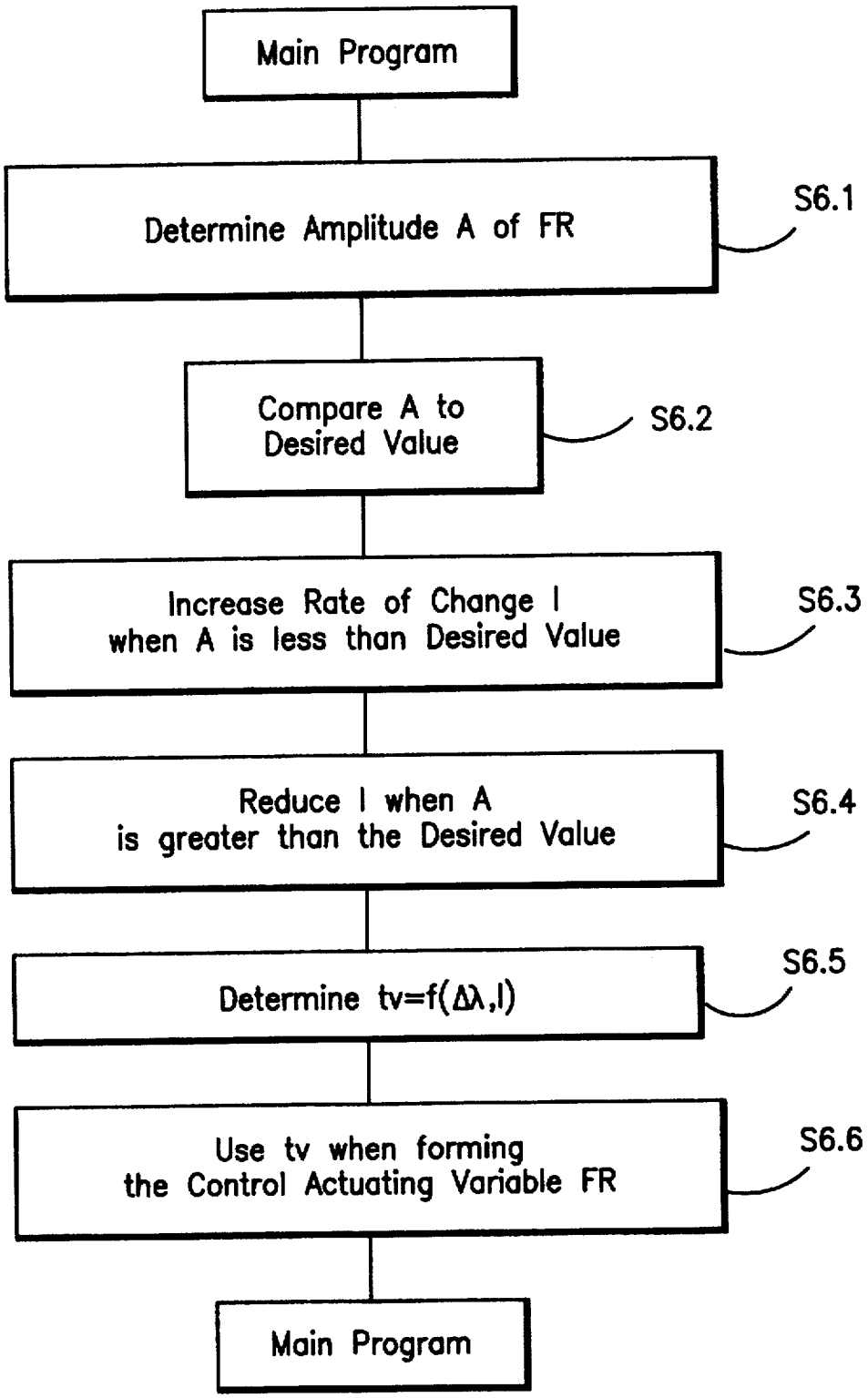
FIG. 6 shows another embodiment of the method of the invention also in the context of a flowchart; and, FIG. 7 is a schematic block diagram of an embodiment of the method of the invention wherein intervention is made via a probe mounted rearwardly of the catalytic converter.

FIG. 6 shows a further embodiment of the method of the invention wherein, additionally, the amplitude A of the control actuating variable is adjusted to a desired value. In this way, the increased catalytic converter load is countered which would result as a consequence of the amplitude which becomes greater with increasing dead time. For this purpose, in step S6.1, the amplitude A of the control actuating variable FR is first determined, for example, by halving the spacing of the extreme values of the control actuating variable or by detecting the spacing of the extreme values from the line FR=1. Thereafter, a step S6.2 operates to effect a comparison of the determined amplitude A to a desired value.

In the following, the rate of change I is increased when the amplitude A is less than the desired value and is reduced when the amplitude A is greater than the desired value. For this purpose, steps S6.3 and S6.4 function to provide the alternatives. In step S6.5, the delay time tv is determined as a function of the desired Δλ and the rate of change I. Thereafter, a step S6.6 follows in which the delay time tv is used when forming the control actuating variable FR in the subsequent main program.

The invention can be advantageously realized for a control which includes a first probe forward of the catalytic converter and a second probe rearward thereof. The first probe functions as a control probe and the second probe functions as a guide probe. The intervention of the guide probe on the control takes place via the control probe linearly with the control parameter Δλ. In this way, it is possible to preset a desired λ shift via the guide probe rearward of the catalytic converter. The algorithm described above for converting Δλ into a delay time tv then provides the corresponding tv time for each operating point of the engine which is necessary to adjust this Δλ.

Figure 7:
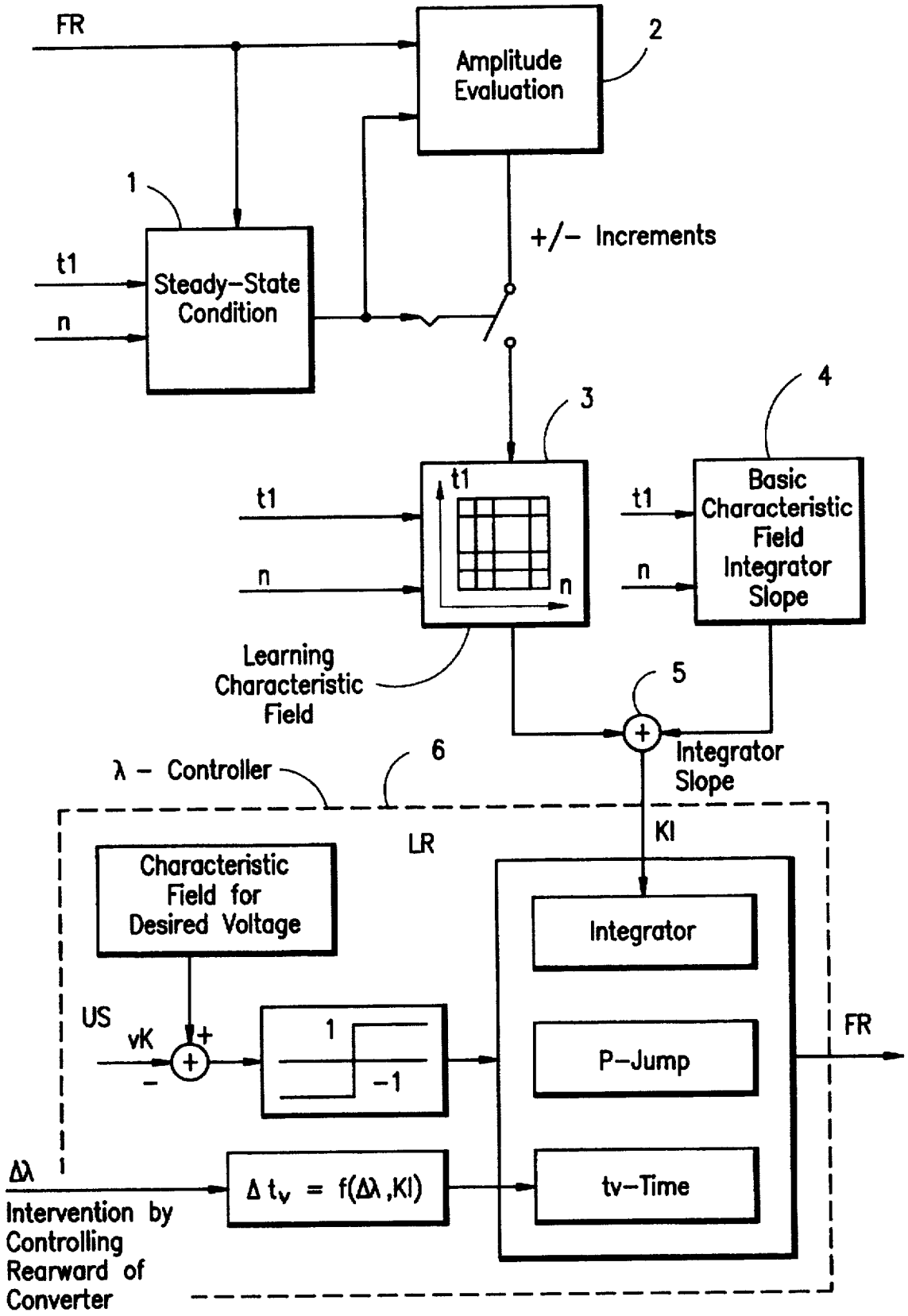

The block diagram of FIG. 7 shows an embodiment of the method of the invention with an intervention via a probe mounted rearwardly of the catalytic converter. In this intervention, the integrator slope (that is, the rate of change of the control actuating variable) is so adapted to the deterioration of the probe forward of the catalytic converter that the amplitude of the controller is held to a constant value independently of the probe parameters. The function of the blocks is explained below.

Block 1: A steady-state operating state is present as soon as the engine has been operated a predetermined time in a defined load-rpm window. If this condition is satisfied, then a check is made as to whether the ratio of the lengths of positive and negative ramps of FR of the λ-controller lies within a band of 1. If this is given, then a steady-state condition is present.

Block 2: With the presence of a steady-state condition, block 2 is activated. Here, the amplitude of FR is determined and this amplitude is further processed via a lowpass filter. A deviation of the filtered amplitude from the desired value leads to a corresponding corrective quantity for the next block 3. For example, if it is determined that the amplitude has increased, then a value is outputted which leads to a reduction of the integrator speed at this operating point.

Block 3: Block 3 defines a learning characteristic field which must lie in a write-read memory having a battery backup. For each load-rpm region, the accumulated corrective value is stored with respect to the integration speed.

Block 4: In block 4, a basic characteristic field is defined for the integrator slope.

Block 5: In this summation point, the effective integrator slope is formed from the values of the basic characteristic field and the learning characteristic field. This integrator slope is then a measure for the actual dead time. With the foregoing, a proper correction of the tv intervention takes place. The block 6 schematically represents the λ-controller and its three states: integration, p-jump and tv-time. The tv-time is predetermined by the Δλ which is pregiven by the intervention of the guide probe rearward of the catalytic converter.

It is understood that the foregoing description is that of the preferred embodiments of the invention and that various changes and modifications may be made thereto without departing from the spirit and scope of the invention as defined in the appended claims.

What is claimed is:

1. A method of controlling the composition of the air/fuel mixture for an internal combustion engine having a control system defining a control path and wherein a control actuating variable (FR) is generated, the method comprising the steps of:

monitoring a periodic oscillation of the control actuating variable (FR) and forming the mean value of said oscillation;

determining the dead time (tt) of said control system from the performance of said control actuating variable (FR); and, influencing said mean value by changing a delay time (tv) while considering said dead time (tt) to thereby delay a change of sign of said control actuating variable (FR).

2. The method of claim 1, wherein said dead time (tt) of the control path is determined by evaluating the amplitude (A) of said control actuating variable (FR).

3. The method of claim 2, wherein the rate of change (I) of said control actuating variable (FR) is so changed that said amplitude (A) adjusts to a pregiven amplitude; said delay time (tv) is increased when said rate of change (I) is reduced; and, said delay time (tv) is reduced when said rate of change (I) is increased.

4. The method of claim 3, wherein said engine includes a catalytic converter and an exhaust-gas probe mounted rearward of said catalytic converter; and, wherein the method further comprises the step of deriving a desired value for said mean value of said oscillation from the signal of said exhaust-gas probe.

5. The method of claim 4, wherein said method is carried out in a steady-state operating state defined when said engine is operated for a predetermined time in a defined load-rpm window.

6. The method of claim 5, wherein a check is made as to whether the ratio of the lengths of the positive and negative ramps of said control actuating variable (FR) lie within a band of 1 thereby defining a further condition for said steady-state operating state.

7. The method of claim 6, further comprising the steps of:

determining the amplitude (A) of said control actuating variable (FR) when said steady-state operating state is present;

processing said amplitude (A) through a lowpass filter;

determining a deviation of said filtered amplitude from the desired value; and, reducing the rate of change (I) of the control actuating variable (FR) when the amplitude (A) is greater than the desired value and increasing the rate of chance (I) when the amplitude (A) is less than the desired value.

8. The method of claim 7, wherein the corrections of said amplitude (A) are stored in a learning characteristic field held in a battery-buffered write-read memory.

9. The method of claim 8, wherein said correction of said amplitude (A) is formed by logically coupling values from a base characteristic field with values from said learning characteristic field.

10. The method of claim 9, wherein the effective integrator slope is formed from the values of said base characteristic field and the values of said learning characteristic field as a criterion for the actual dead time with which the proper correction of the delay time (tv)-intervention is made.

* * * * *